US006566993B1

(12) United States Patent
Otsuka et al.

(10) Patent No.: US 6,566,993 B1
(45) **Date of Patent: *May 20, 2003**

(54) SURFACE-MOUNT COIL AND METHOD FOR MANUFACTURING SAME

(75) Inventors: Kazuhiko Otsuka, Tokyo (JP); Satoshi Kinoshita, Tokyo (JP); Tomohiko Morijiri, Tokyo (JP); Tomoo Kashiwa, Tokyo (JP)

(73) Assignee: Taiyo Yuden Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/718,967

(22) Filed: Nov. 22, 2000

(30) Foreign Application Priority Data

Nov. 26, 1999 (JP) ..... 11-335735

(51) Int. Cl.[7] ..... H01F 27/02

(52) U.S. Cl. ..... 336/83; 336/96; 336/192; 336/200

(58) Field of Search ..... 336/83, 90, 96, 336/192, 198, 200, 232, 196, 208, 183, 185; 29/602.1, 605, 606

(56) References Cited

U.S. PATENT DOCUMENTS 6,154,112 A * 11/2000 Aoba et al. ..... 336/192

FOREIGN PATENT DOCUMENTS

| | | |
|---|---|---|
| EP | 0845792 | 6/1998 |
| EP | 0921542 | 6/1999 |
| JP | 58079706 | 5/1983 |
| JP | 02235305 | 9/1990 |
| JP | 10172832 | 6/1998 |
| JP | 11040424 | 2/1999 |

* cited by examiner

*Primary Examiner*—Lincoln Donovan
*Assistant Examiner*—Tuyen T. Nguyen
(74) *Attorney, Agent, or Firm*—Katten Muchin Zavis Rosenman

(57) ABSTRACT

A surface mountable coil is provided with a drum-shaped core including a body portion and raised portion each raised portion having a peripheral surface and an end surface, a winding wire wound around the body portion, an encapsulating member, base electrodes, and terminal electrodes. The encapsulating member exposes some portions of the base electrodes on the peripheral surfaces and substantially the whole base electrodes on the end surfaces. By exposing the portions of the base electrodes on the peripheral surfaces and whole base electrodes on the end surfaces, the contact strength between the base electrodes and the terminal electrodes can be substantially increased.

18 Claims, 8 Drawing Sheets

SURFACE-MOUNT COIL AND METHOD FOR MANUFACTURING SAME

FIELD OF THE INVENTION

The present invention relates to a surface-mount (or surface mountable) coil; and, more particularly, to an electrode structure thereof and a method of making same.

BACKGROUND OF THE INVENTION

Nowadays, miniaturized chip type electronic components are extensively employed in high density surface mounting on a printed circuit board by using a chip mounter. Referring to FIGS. 10 and 11, there are illustrated a partial cut-away view and a cross sectional view of a conventional winding type surface mountable chip coil 10 having a wiring wound around a core thereof. The coil 10 typically includes a drum-shaped core 4 having a body portion 1 and raised portions 2, 3 integrally formed at two opposite ends of the body portion 1; a winding wire 5 wound around the body portion 1; base electrodes 6-1, 6-2 disposed on two end surfaces 2*b*, 3*b* and also on parts of peripheral surfaces 2*a*, 3*a* of the raised portions 2, 3, two ends (not shown) of the winding wire 5 being connected to the base electrodes 6-1, 6-2; an encapsulating member 7 covering the whole structure excepting parts of the base electrodes 6-1, 6-2 at the central regions of the end surfaces 2*b*, 3*b* of the raised portions 2, 3; and terminal electrodes 8-1, 8-2 covering exposed base electrodes 6-1*a*, 6-2*a* up to portions of the encapsulating member 7 on the peripheral surfaces 2*a* and 3*a*.

In the surface mountable coil 10 illustrated above, the drum-shaped core 4, to which the base electrodes 6-1, 6-2 can be directly attached, is made of a magnetic material, e.g., nickel-zinc based ferrite of a high resistivity, or an insulating material, e.g., alumina. The base electrodes 6-1, 6-2 are conductive layers, each including therein Ag, Ag-Pt or Cu film formed by dip-baking or plating, and a conductive material, e.g., Ni/Sn or Sn alloy formed thereon. The winding wire 5 is a conductive wire coated with an insulating film, e.g., polyurethane, polyamideimide, and the like with a diameter of 0.03~0.15 mm and the respective end portions thereof are connected to the base electrodes 6-1, 6-2 on the peripheral surfaces 2*a*, 3*a* of the raised portions 2, 3 by means of welding, thermocompression bonding, ultrasonic vibration, or a combination thereof. The encapsulating member 7 is formed by injection molding of an epoxy based synthetic resin.

After forming the encapsulating number 7, the terminal electrodes 8-1, 8-2 are formed on the regions corresponding to the end surfaces 2*b*, 3*b* and the peripheral surfaces 2*a*, 3*a* of the raised portions 2, 3, respectively, and the finished structure is shaped to provide the thin miniaturized surface mountable coil 10.

In the conventional surface mountable coil described above, only small portions 6-1*a*, 6-2*a* of the base electrodes 6-1, 6-2 on the central parts of the end surfaces 2*b*, 3*b* of the core 4 are exposed through the encapsulating member 7. Therefore, the contact areas between the base internal electrodes 6-1, 6-2 and the terminal electrodes 8-1, 8-2 are limited to be the small portions of the base electrodes 6-1, 6-2 exposed through the encapsulating member 7, resulting in a structurally insufficient adhesion strength between the base and the terminal electrodes.

As a result, in case where the surface mountable coil 10 is soldered on a printed circuit board and subjected to thermal variation, e.g., by a thermal cycle test (TCT test), the terminal electrodes 8-1, 8-2 may be delaminated from contact portions of the base electrodes 6-1, 6-2, i.e., the exposed base electrodes 6-1*a*, 6-2*a*, due to thermally induced tensile stresses on the terminal electrodes 8-1, 8-2.

The present inventors have conducted a series of experiments and found that the mechanical contact strength between the base electrodes 6-1, 6-2 and the terminal electrodes 8-1, 8-2 can be substantially increased when the terminal electrodes 8-1, 8-2 are in contact with at least on portions of the peripheral surfaces 2*a*, 3*a* as well as the base electrodes 6-1, 6-2 on the end surfaces 2*b*, 3*b*.

One may be tempted to remove parts of the encapsulating member 7 off the peripheral surfaces 2*a*, 3*a* after molding in order to expose the base electrodes 6-1, 6-2 underneath, but the encapsulating member 7 circumferentially formed thereon is too rigid to be readily removed.

Another way to expose the base electrodes 6-1, 6-2 on the peripheral surfaces 2*a*, 3*a* may be to remove a gap clearance between the inner surface of the mold and the base electrodes 6-1, 6-2 disposed on the peripheral surfaces 2*a*, 3*a* to prevent the synthetic resin from being injected through the gap during the molding process to reach the end surfaces 2*b*, 3*b* of the raised portion 2, 3. Since the gap serves as an escape path of the injected resin during the molding process, the core 4 and/or the wire 5 can be subjected to a high pressure induced by the absence of the escape path. The escape path is necessary for the synthetic resin to uniformly flow into and fill in the mold cavity, and consequently, burrs (surplus encapsulating member 7 on the peripheral surfaces 2*a*, 3*a*) would be unavoidably formed.

SUMMARY OF THE INVENTION

It is, therefore, an object of the present invention to provide a surface mountable coil having a reliable electrode structure, and method for the manufacture thereof.

In accordance with a preferred embodiment of the present invention, there is provided a surface mountable coil comprising:

- a core including a body portion and two raised portions disposed at two opposite ends of the body portion, each of the raised portions having an end surface and a peripheral surface;
- a winding wire wound around the body portion;
- a pair of base electrodes, each of the base electrodes being disposed on the peripheral surface and the end surface of the raised portions, and two ends of the winding wire being connected to the base electrodes respectively;
- an encapsulating member extending from a portion of one base electrode to a portion of the other base electrode to thereby cover the region therebetween while exposing a part of the base electrode on each peripheral surface and substantially the entire base electrode on each end surface; and
- a pair of terminal electrodes respectively covering the exposed internal electrodes and the end portions of the encapsulating member on the peripheral surfaces of the raised portions,
- wherein the end portions of the encapsulating member on the peripheral surfaces have peak portions extending toward the end surfaces of the raised portions and valley portions retracting away from the end surfaces.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Figure 1:
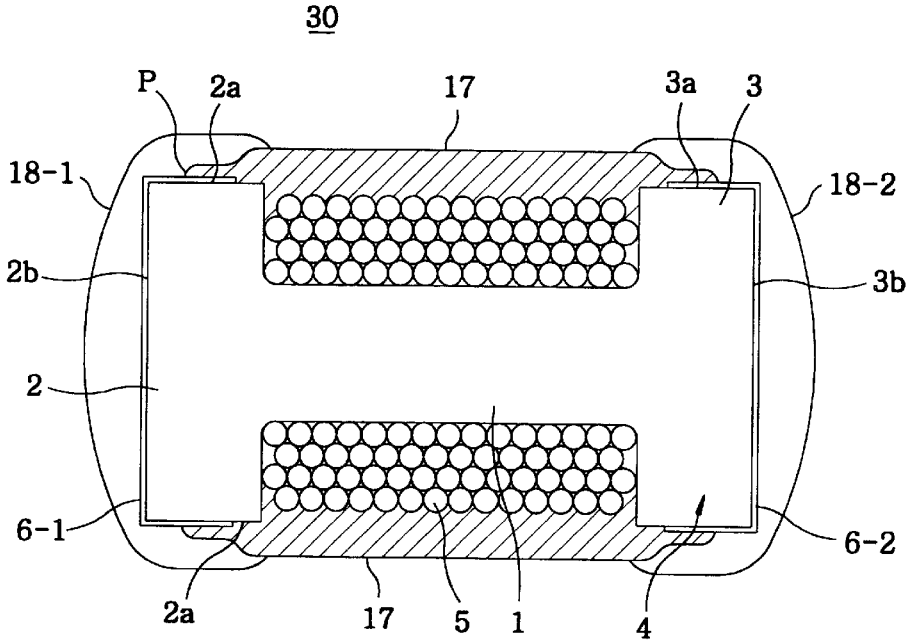
FIG. 1 shows a cross-sectional view of a surface mountable coil in accordance with a preferred embodiment of the invention.

The preferred embodiments of a surface mountable coil in accordance with the present invention will now be described with reference to FIGS. 1 to 9. Like reference numerals and characters will be used to designate like parts of the conventional coil 10 and the preferred embodiments of the invention.

Figure 2:
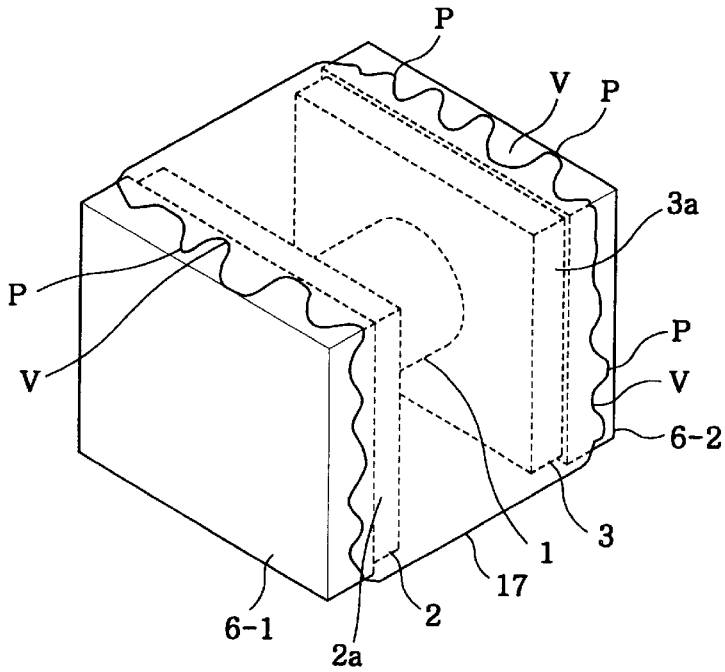
FIG. 2 provides a perspective view of the surface mountable coil prior to the formation of terminal electrodes, illustrating an overlay configuration of an encapsulating member on base electrodes at the peripheral surfaces of the raised portions of a core.

Referring to FIGS. 1 and 2, a surface mountable coil 30 includes a drum-shaped core 4 having a body portion 1 and raised portions 2, 3 integrally formed at two opposite ends of the body portion 1; a winding wire 5 wound around the body portion 1; base electrodes 6-1, 6-2 disposed on end surfaces 2*b*, 3*b* and peripheral surfaces 2*a*, 3*a* of the raised portions 2, 3, the respective end portions (not shown) of the wire 5 being connected to the base electrodes 6-1, 6-2; an encapsulating member 17 extending from a portion of the base electrode 6-1 on the peripheral surface 2*a* to a portion of the base electrode 6-2 on the peripheral surface 3*a*; and terminal electrodes 18-1, 18-2 covering exposed portions of the base electrodes 6-1, 6-2 and end portions of the encapsulating member 17 on the peripheral surfaces 2*a*, 3*a*. In accordance with the present invention, the edges of the encapsulating member 17 have peak (P) and valley (V) portions alternatively disposed along the peripheral surfaces 2*a*, 3*a* of the raised portions 2, 3, said P and V portions extending towards and retracting away from the end surfaces 2*b*, and 3*b*, respectively.

In other words, portions of the base electrodes 6-1, 6-2 on the peripheral surfaces 2*a*, 3*a* are not covered with the encapsulating member 17. Leading edges of the progression part P portions may remain on the peripheral surfaces 2*a*, 3*a* or may reach the end surfaces 2*b*, 3*b*.

Figure 10:
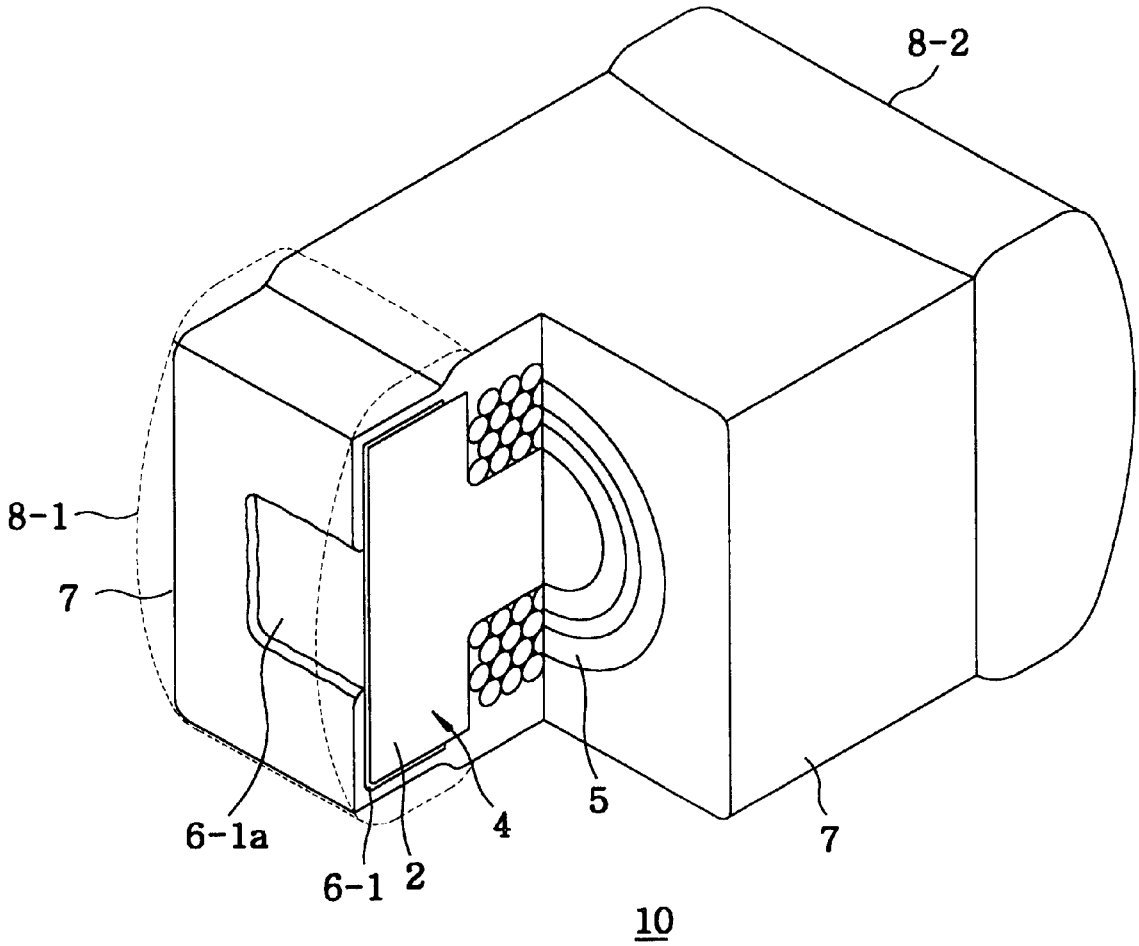
FIG. 10 (PRIOR ART)
FIG. 10 exemplifies a cut-away view of a conventional surface mountable coil.
Figure 11:
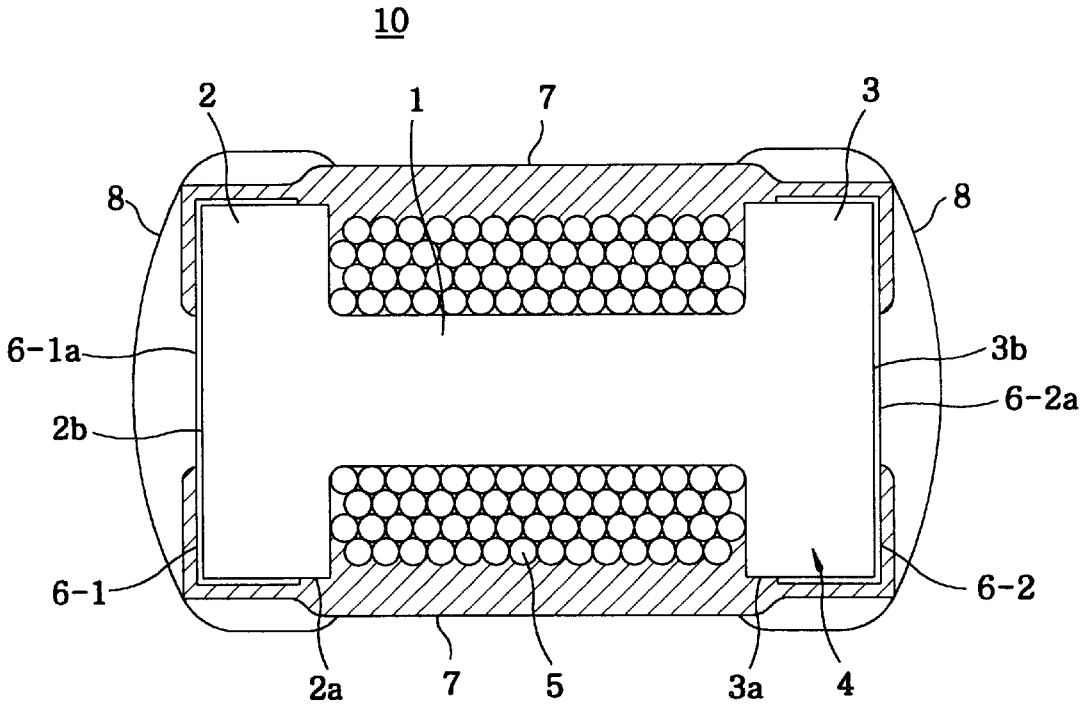
FIG. 11 (PRIOR ART)
FIG. 11 exhibits a cross-sectional view of a conventional surface mountable coil.

Since at least some portions of the base electrodes 6-1, 6-2 on the peripheral surfaces 2*a*, 3*a* are exposed without being covered by the encapsulating member 17 as described above, the terminal electrodes 18-1, 18-2 can encompass virtually the entire base electrodes 6-1, 6-2 on the end surfaces 2*b*, 3*b* and the exposed portions thereof on the peripheral surfaces 2*a*, 3*a*. As a result, the mechanical adhesive contact strength between the base electrodes 6-1, 6-2 and the terminal electrodes 18-1, 18-2 of the present invention is substantially increased compared with that of a conventional surface mountable coil 10 shown in FIGS. 10 and 11 having the contact areas only at the central parts of the end surfaces; and thus the delamination of the terminal electrodes 18-1, 18-2 from the base electrodes 16-1, 16-2 can be effectively prevented and the reliability can be increased.

Figure 3:
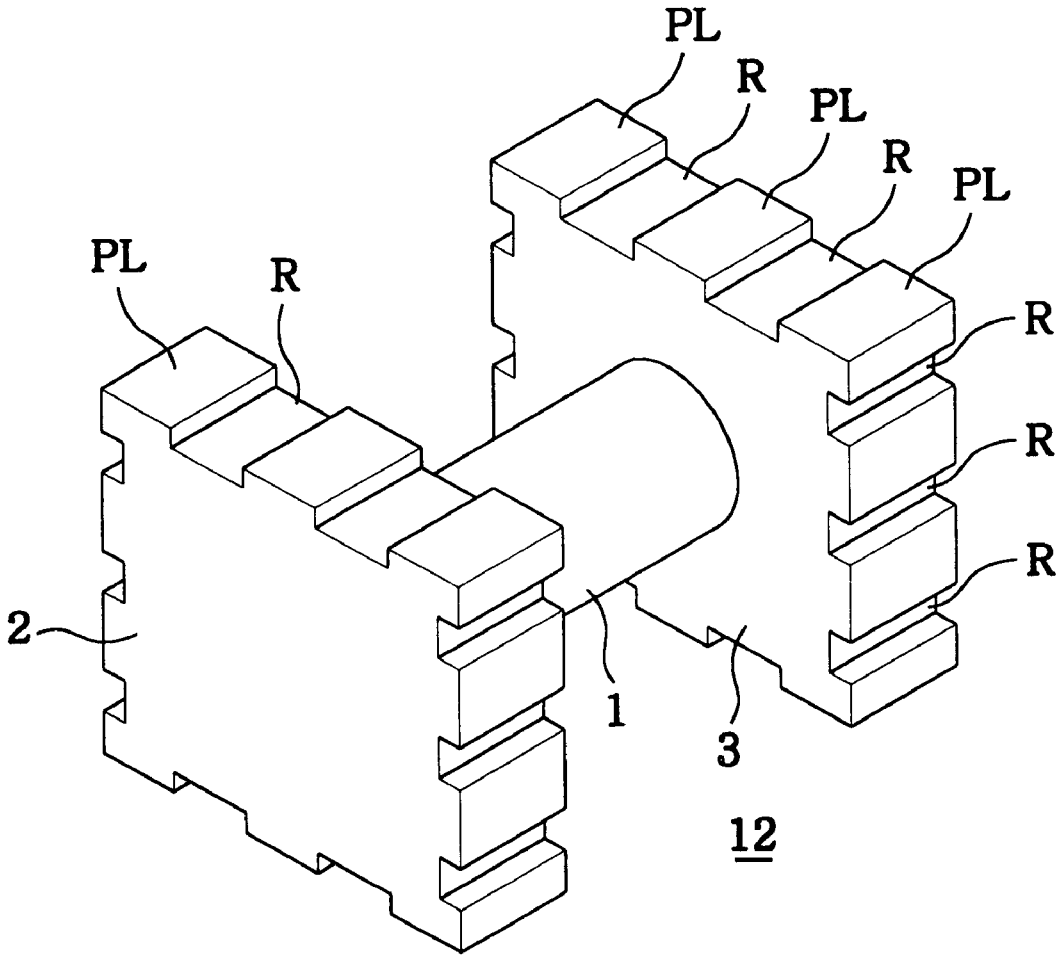
FIG. 3 describes a perspective view of a drum-shaped core in accordance with a first preferred embodiment of the invention.

The wavy profile of the encapsulating member 17 on the Iperipheral surfaces 2*a*, 3*a* shown in FIG. 2 can be obtained by using, e.g., a drum-shaped core 12 having plateaus (PL) and recesses (R) alternately formed on the peripheral surfaces of the raised portions 2, 3 of the core 12 as illustrated in FIG. 3, the recesses running parallel to the axial direction of the body portion 1 of the core. That is, when molding an encapsulating material, which forms the encapsulating member 17, after forming the base electrodes 6-1, 6-2 on the drum-shaped core 12 as in FIG. 1, the gaps between the mold and the recesses serve as escape paths for the encapsulating material. Therefore, the encapsulating material would penetrate more along the recesses and less along the plateaus towards the end surfaces of the raised portions 2, 3, resulting in the wavy profile of the encapsulating member 17 exposing portions of the base electrodes 6-1, 6-2 on the peripheral surfaces 2*a*, 3*a* of the raised portions 2, 3 as shown in FIG. 2. Some of the encapsulating material penetrating along the recesses may reach the end surfaces of the raised portions 2, 3 and become burrs after being solidified. Such burrs are relatively easy to remove because they are not linked together. The burrs may not be removed before forming the terminal electrodes 18-1, 18-2.

Figure 4A:
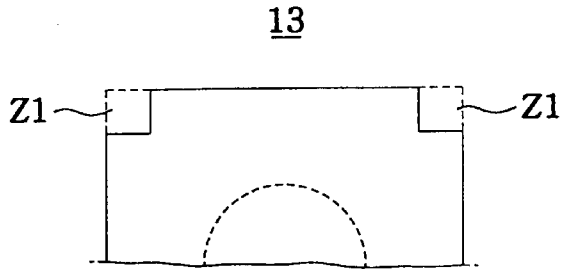
FIGS. 4A to 4C illustrate various exemplary structures of a raised portion of a drum-shaped core in accordance with a second preferred embodiment of the invention.
Figure 4B:
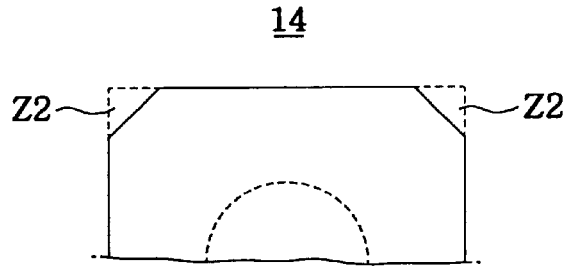
Figure 4C:
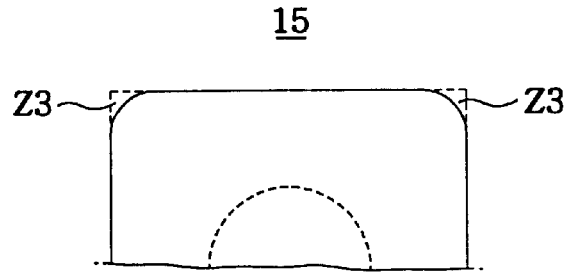

The raised portions 2, 3 are preferably of a polygonal shape and more preferably of a rectangular shape when viewed along the axial direction of the body portion 1. In such a case, the escape paths for the encapsulating material can be secured by providing at the corners of the peripheral surfaces 2*a*, 3*a* of the raised portions 2, 3 of the drum-shaped core 4 shown in FIG. 1, cutaway portions Z1, Z2, Z3 extending along the axial direction of the core 4 as shown in FIGS. 4A to 4C. The cutaway portions Z1 of a drum-shaped core 13 in FIG. 4A are of a rectangular shape; a drum-shaped core 14 with the cutaway portions Z2 in FIG. 4B has slanted corners, and a core 15 with the cutaway portions Z3 in FIG. 4C has removed corners when viewed along the axial direction of the body portion of each core. Providing escape paths at the corners of a core is advantageous in that it is relatively easy to form the cutaway portions Z1, Z2, Z3 at the corners and that such cutaway portions can be made large enough to serve as the escape paths effectively. It is important to make a sufficiently narrow clearance between the mold and the peripheral surfaces of the raised portions 2, 3 of the drum-shaped cores 4, 12, 13, 14, 15 described above, on which the base electrodes 6-1, 6-2 are disposed, to prevent the encapsulating material from covering the entire peripheral surfaces of the raised portions 2, 3.

Figure 5:
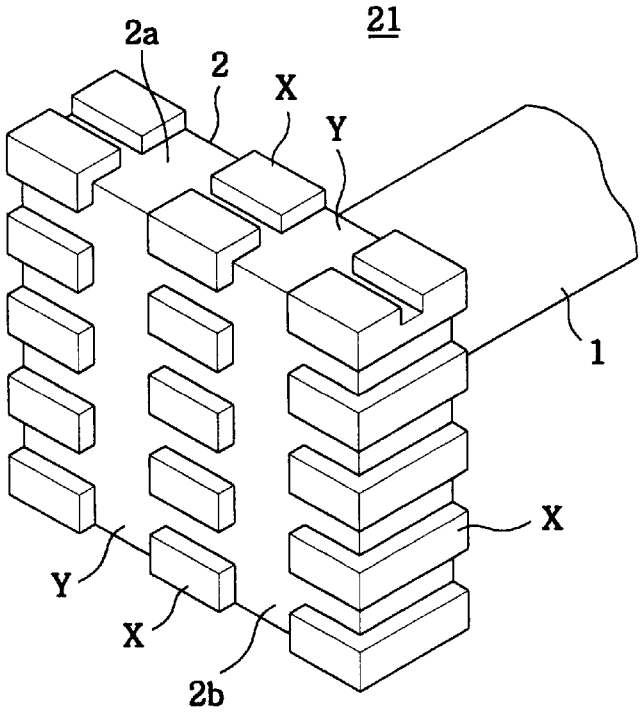
FIG. 5 offers a perspective view depicting a shape of a raised portion of a drum-shaped core in accordance with a third preferred embodiment of the invention.

Referring to FIG. 5, there is illustrated another exemplary drum-shaped core 21 having recesses (Y) and plateaus (X)

both on the end surfaces and on the peripheral surfaces of the raised portions 2, 3 thereof. The recesses may all be linked together as shown in FIG. 5. When molding, the encapsulating material penetrates through the recesses, which serve as the escape paths, towards the end surfaces. By controlling the clearance between the mold and the peripheral surfaces to be small enough such that the encapsulating material does not cover the end surfaces and the plateaus of the peripheral surfaces, it is possible to secure the exposed base electrodes (i.e. uncovered by the encapsulating material) on the end surfaces and portions of the peripheral surfaces.

Figure 6:
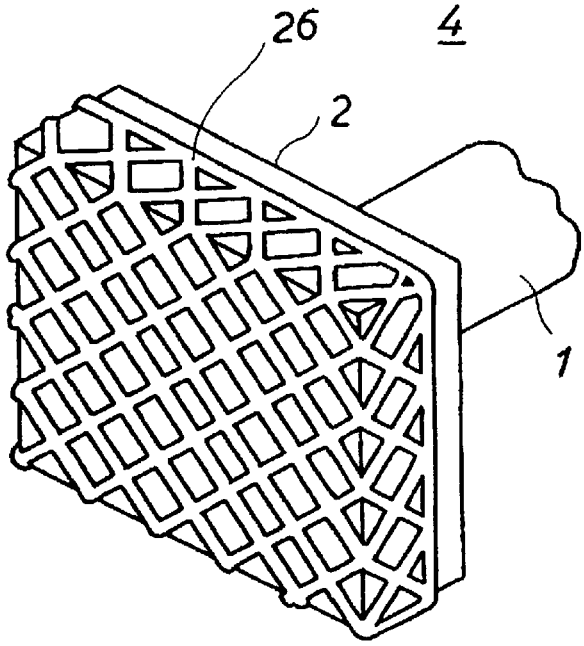
FIG. 6 presents a perspective view of a base electrode in accordance with a preferred embodiment of the present invention.
Figure 7:
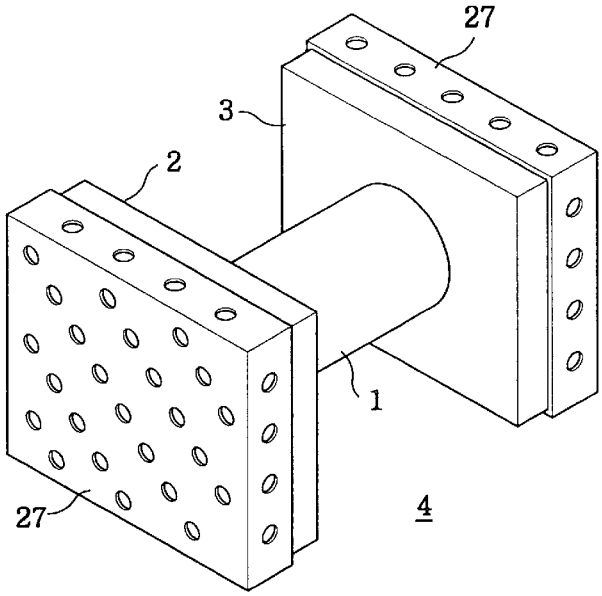
FIG. 7 portrays a perspective view of a base electrode in accordance with another preferred embodiment of the invention.

The base electrodes need not have any specific structure. The base electrodes can be of a structure having planar surfaces as shown in FIGS. 1 and 2. It is preferable, however, to make the base electrodes to have an uneven surface structure with recesses and protrusions. For instance, by providing mesh-shaped base electrodes 26 as shown in FIG. 6 or perforated base electrodes 27 having a plurality of openings as shown in FIG. 7 and then forming the terminal electrodes thereon, the contact between the base and the terminal electrodes can be made on surfaces of various directions and thus the mechanical contact strength can be substantially increased compared with the case when the planar base electrodes are used.

By combining the scheme to obtain exposed base electrodes on the peripheral surfaces of the drum-shaped core as described with reference to FIGS. 1 to 5 and the base electrodes of an uneven surface as in FIGS. 6 and 7, the reliability of the mechanical contact strength between the base and the terminal electrodes can be further improved.

Figure 8:
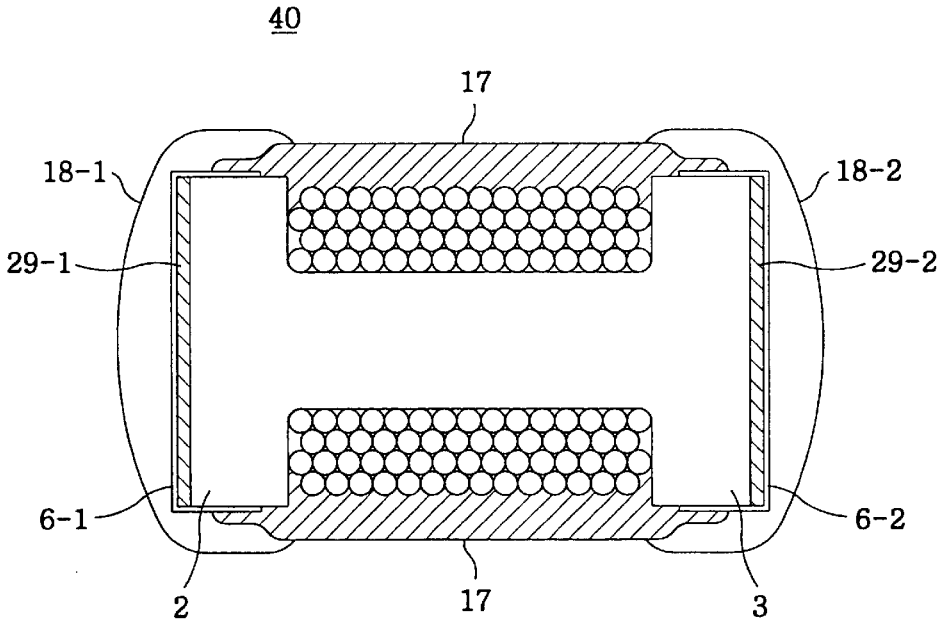
FIG. 8 represents a cross-sectional view of a surface mountable coil in accordance with another preferred embodiment of the invention.

Referring to FIG. 8, there is illustrated a surface mountable coil 40 in accordance with another embodiment of the invention. As shown in the drawing, this embodiment is identical to the one shown in FIG. 1 excepting that there are provided stress buffer layers 29-1, 29-2 between the base electrodes 6-1, 6-2 and the end surfaces of the raised portions 2, 3. The stress buffer layers 29-1, 29-2 serve to reduce the tensile stress exerted on the external electrodes 18-1, 18-2 during a TCT test. In other words, when the external electrodes 18-1, 18-2 and the base electrodes 6-1, 6-2 are pulled outwardly by a tensile stress, only the stress buffer layers 29-1, 29-2 are stretched. Therefore, it becomes more difficult for the external electrodes 18-1, 18-2 to be delarninated from the base electrodes 6-1, 6-2 and for the base electrodes 6-1, 6-2 to be detached from the peripheral surfaces 2*a*, 3*a* and the end surfaces 2*b*, 3*b*.

Silicone resin or rubber-modified epoxy resin can be used as the stress buffer layers 29-1, 29-2.

Figure 9:
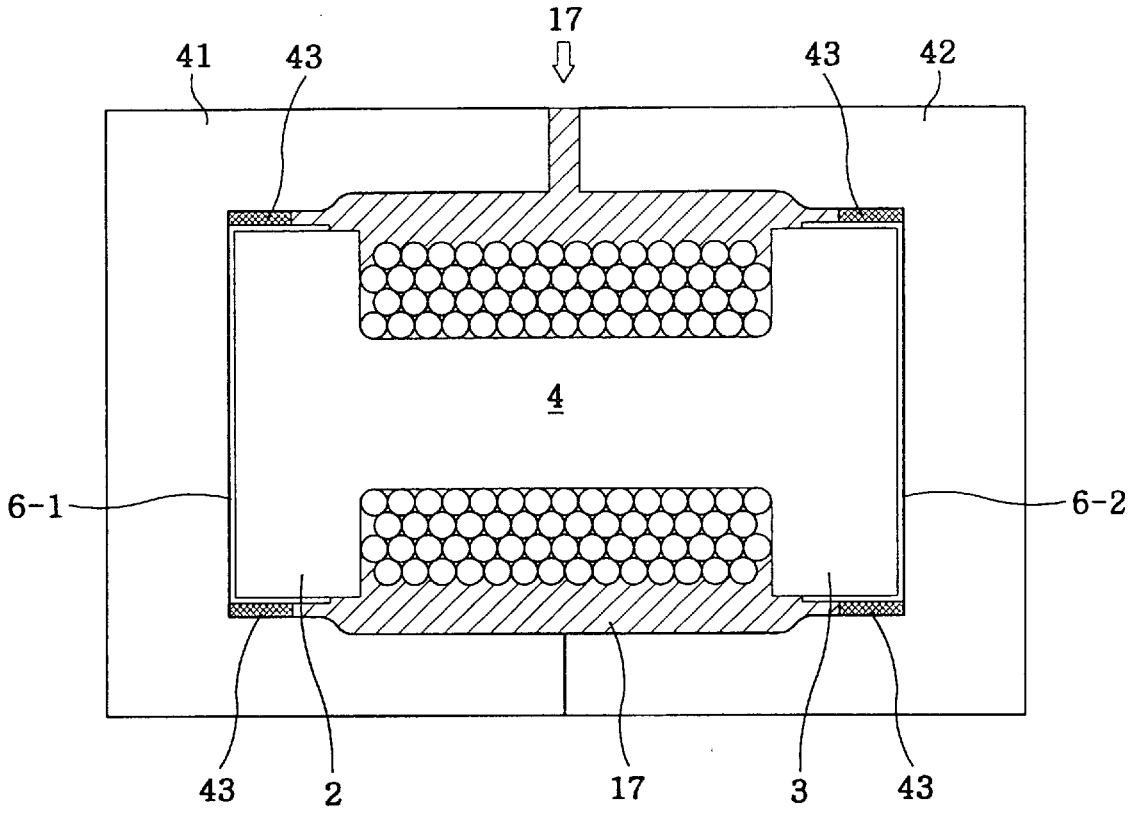
FIG. 9 displays a cross-sectional view of a surface mountable coil during an injection molding process in accordance with the present invention.

The methods for increasing the contact strength of the terminal electrodes described above are achieved by modifying the surface mountable coil itself. However, high contact strength can be also attained by disposing an elastic material 43 on parts of the inner surfaces of the mold pieces 41, 42 facing some portions of the base electrodes on the peripheral surfaces 2*a*, 3*a* of the raised portions 2, 3, and molding the encapsulating material while maintaining the contact between the elastic material 43 and the base electrodes 6-1, 6-2 as illustrated in FIG. 9. By doing so, the encapsulating material fills in the void using the gaps between the mold pieces 41, 42 and the raised portions 2, 3 as the escape paths but cannot penetrate beyond the region where the elastic material 43 is disposed, leaving the base electrodes 6-1, 6-2 in contact with the elastic material 43 uncovered by the encapsulating material.

A heat-resistant resin, e.g., a silicone resin or a rubber-modified epoxy resin, can be used as the elastic material 43.

The base electrodes 6-1, 6-2 and the terminal electrodes 18-1, 18-2 are formed of, e.g., a resin paste containing silver. The encapsulating member 17 is formed of, e.g., a synthetic resin such as an epoxy based resin, phenol resin and silicone resin, or such a resin containing therein powder of a magnetic material or an insulating material.

While the invention has been shown and described with respect to the preferred embodiments, it will be understood by those skilled in the art that various changes and modifications may be made without departing from the scope of the invention as defined in the following claims.

What is claimed is:

1. A surface mountable coil comprising:

a core including a body portion and two raised portions disposed at two opposite ends of the body portion, each of the raised portions having an end surface and a peripheral surface;

a winding wire wound around the body portion;

a pair of base electrodes, each of the base electrodes being disposed on the peripheral surface and the end surface of one of the raised portions, and two ends of the winding wire being connected to the base electrodes respectively, wherein each of the base electrodes is provided with an uneven surface;

an encapsulating member extending from a portion of one base electrode to a portion of the other base electrode to thereby cover the region therebetween while exposing a part of the base electrode on each peripheral surface; and a pair of terminal electrodes respectively covering the exposed base electrodes and end portions of the encapsulating member on the peripheral surfaces of the raised portions, wherein the end portions of the encapsulating member on the peripheral surfaces have peak portions extending toward the end surfaces of the raised portions and valley portions retracting away from the end surfaces.

2. The surface of mountable coil of claim 1, wherein the encapsulating member exposes the entire base electrodes on the end surfaces.

3. The surface mountable coil of claim 1, wherein the peripheral surfaces are provided with recesses.

4. The surface mountable coil of claim 1, wherein each of the peripheral surfaces has corner regions and is provided with cutaway portions at the corner regions.

5. The surface mountable coil of claim 1, wherein the peripheral surfaces and the end surfaces are provided with recesses and protrusions.

6. The surface mountable coil of claim 1, wherein each of the base electrodes is a mesh-shaped electrode.

7. The surface mountable coil of claim 1, wherein each of the base electrodes is a perforated electrode having a plurality of openings.

8. The surface mountable coil of claim 1, further comprising a stress buffer layer disposed between each of the base electrodes and the end surface of each of the raised portions.

9. A method for manufacturing the surface mountable coil of claim 1, comprising the steps of:

preparing the core provided with the winding wire and the base electrodes;

providing a mold having an elastic material on parts of an inner surface thereof, the elastic material facing portions of the base electrodes on the peripheral surfaces;

molding the encapsulating member by using the mold while maintaining the contact between the elastic material and the portions of the base electrodes on the peripheral surfaces; and forming the terminal electrodes.

10. A surface mountable coil comprising:

a core including a body portion and two raised portions disposed at two opposite ends of the body portion, each of the raised portions having an end surface and a peripheral surface;

a winding wire wound around the body portion;

a pair of base electrodes, each of the base electrodes being disposed on the peripheral surface and the end surface of one of the raised portions, and two ends of the winding wire being connected to the base electrodes respectively, wherein each of the base electrodes has a plurality of openings through which parts of said one of the raised portions are exposed;

an encapsulating member extending from a portion of one base electrode to a portion of the other base electrode to thereby cover the region therebetween; and a pair of terminal electrodes respectively covering the exposed base electrodes and end portions of the encapsulating member on the peripheral surfaces of the raised portions.

11. The surface of mountable coil of claim 10, wherein the encapsulating member exposes the entire base electrodes on the end surfaces.

12. The surface mountable coil of claim 10, wherein the peripheral surfaces are provided with recesses.

13. The surface mountable coil of claim 10, wherein each of the peripheral surfaces has comer regions and is provided with cutaway portions at the comer regions.

14. The surface mountable coil of claim 10, wherein the peripheral surfaces and the end surfaces are provided with recesses and protrusions.

15. The surface mountable coil of claim 10, wherein each of the base electrodes is a mesh-shaped electrode.

16. The surface mountable coil of claim 10, wherein each of the base electrodes is a perforated electrode having a plurality of openings.

17. The surface mountable coil of claim 10, further comprising a stress buffer layer disposed between each of the base electrodes and the end surface of each of the raised portions.

18. A method for manufacturing the surface mountable coil of claim 10, comprising the steps of:

preparing the core provided with the winding wire and the base electrodes;

providing a mold having an elastic material on parts of an inner surface thereof, the elastic material facing portions of the base electrodes on the peripheral surfaces;

molding the encapsulating member by using the mold while maintaining the contact between the elastic material and the portions of the base electrodes on the peripheral surfaces; and forming the terminal electrodes.

* * * * *